US007198169B2

(12) United States Patent
Silk

(10) Patent No.: US 7,198,169 B2
(45) Date of Patent: Apr. 3, 2007

(54) STORAGE CONTAINER CONVERTIBLE TO A CLOSED OBJECT

(76) Inventor: Terence J. Silk, 473 Bagley Rd., Southbury, CT (US) 06488

( * ) Notice: Subject to any disclaimer, the term of this patent is extended or adjusted under 35 U.S.C. 154(b) by 0 days.

(21) Appl. No.: 10/835,037

(22) Filed: Apr. 29, 2004

(65) Prior Publication Data

US 2004/0262310 A1 Dec. 30, 2004

Related U.S. Application Data

(60) Provisional application No. 60/466,209, filed on Apr. 29, 2003.

(51) Int. Cl.
*B65D 41/04* (2006.01)

(52) U.S. Cl. ..... 220/288; 273/128 R

(58) Field of Classification Search ..... 220/288, 220/289, 290; 273/128 R, 57.2, 128 A
See application file for complete search history.

(56) References Cited

U.S. PATENT DOCUMENTS 4,183,536 A * 1/1980 Platt ..... 473/570
5,207,720 A * 5/1993 Shepherd ..... 473/446
5,531,442 A * 7/1996 Gill ..... 473/588
6,968,965 B1 * 11/2005 Cunningham ..... 215/44

* cited by examiner

*Primary Examiner*—Lien M. Ngo
(74) *Attorney, Agent, or Firm*—Ware, Fressola, Van Der Sluys & Adolphson, LLP

(57) ABSTRACT

A storage container convertible to a permanently closed object has a receptacle with an outside surface corresponding to the partial exterior of a closed object; and with an interior surface defining a storage chamber. A lid covers the entry opening and thereby closes the storage chamber, the lid having an outside surface corresponding to the remaining exterior of the closed object. The receptacle and lid together define releasable engagement structure for removably securing the lid on the receptacle, wherein the lid may be removed to place and remove items from the storage chamber, the releasable engagement structure incrementally spacing the outside surfaces corresponding to the partial and remaining exterior of the closed object. The receptacle and lid further define the snap-fit securing structure for permanently securing the lid on the receptacle with the outside surfaces corresponding to the partial and remaining exteriors of the closed object co-joined. The closed object may have the shape of an object of play, e.g. a hockey puck. The releasable engagement structure may be cooperative threads on a bayonet-type engagement. The snap-fit engagement is a flange received in a groove.

20 Claims, 4 Drawing Sheets

STORAGE CONTAINER CONVERTIBLE TO A CLOSED OBJECT

RELATED APPLICATIONS

This application claims priority to my provisional application Ser. No. 60/466,209 filed Apr. 29, 2003.

FIELD OF THE INVENTION

The invention herein relates to a storage container and particularly a storage container useful in marketing small items, wherein the storage container is convertible to a permanently closed object after consumption or use of the small items.

BACKGROUND OF THE INVENTION

Candy, gum, and other small consumable items are sold in packaging that provides for closed storage and selective removal of the items for consumption. Plastic boxes with lids or dispensers are sometimes utilized, such as in selling Tic Tac brand mints. Small tins or cardboard boxes are used to package and sell mints and lozenges, such as Sucrets brand lozenges. Small consumable items are also sold in cardboard boxes (such as Milkduds brand candies), sealed plastic bags (M&M brand candies) and rolls (Lifesavers brand candies). Such packaging is suitable for the purpose of selling and the small consumable items and storing them until consumption, but rarely have any utility once the consumable items are gone. Also, although the packages may have attractive trade dress, they lack any true uniqueness and panache in and of themselves.

Candy, gum and other small consumables are also often linked to a sports marketing theme. Bubble gum and baseball cards are a classic example of such marketing tie-ins, and ice cream has been sold in plastic replicas of team logo baseball batting helmets. Purchasers are attracted to the product by the dual lure of the sports memorabilia as well as the product itself. The businesses marketing such products reap additional benefits in that product awareness continues if the associated packaging item is retained by the purchaser after consumption of the product.

It is believed that a sports associated appeal of a product could be enhanced if the product were useful after consumption of the items sold therein. It is also believed that this concept has applicability outside the area of sports and in association with items other than edibles.

SUMMARY OF THE INVENTION

Accordingly, it is a principal object of the invention herein to provide a storage container for small items that is convertible to a permanently closed object.

It is an additional object of the invention herein to provide a container suitable for selling small items and which, after disposition of the small items, may be permanently closed to form an object of play.

It is a further object of the invention herein to provide a container for selling candy or gum and which is convertible to a sports object, such as a hockey puck or baseball.

It is also an object of the invention to provide an improvement in both the packaging, trade dress, and long-term product awareness associated with the sale of products.

In carrying out the objects of the invention herein, a storage container convertible to a permanently closed object has a receptacle and a lid. The receptacle has an outside surface corresponding to the partial exterior of the closed object and has an interior surface defining a storage chamber, the interior surface also defining a bore extending from an entry opening into the storage chamber. The lid covers the entry opening, thereby closing the storage chamber. The lid has an outside surface corresponding to the remaining exterior of the closed object, and the lid includes a skirt receivable in the bore of the receptacle. The bore and skirt together define releasable engagement means for removably securing the lid on the receptacle, wherein the lid may be removed to place items in and remove items from the storage chamber. The releasable engagement means incrementally spaces the outside surfaces corresponding to the partial and remaining exterior of the closed object. Snap-fit securing means are also defined by the bore and skirt together, for permanently securing the lid on the receptacle with the outside surfaces corresponding to the partial and remaining exteriors of the closed object co-joined.

According to one aspect of the invention, the closed object is an object of sports play. The object of sports play may be a hockey puck, ball or other such object.

According to other aspects of the invention, the releasable engagement means for removably securing the lid on the receptacle are mating screw threads formed on the bore of the receptacle and on the skirt of the lid. Alternatively, bayonet-style releasable engagement means or other releasable engagement means may be provided.

Also according to aspects of the invention, the snap-fit securing means are a flange and groove configuration. In a more particular aspect, a flange extends outwardly from the skirt of the lid, and a groove extends inwardly from the surface of the bore. In a particular aspect, the groove is adjacent the entry opening to the bore, and extends peripherally around the bore. Also more particularly, the flange extends from the skirt, and extends peripherally around the skirt.

Other and more specific objects and features of the invention herein will in part be readily understood by those skilled in the art and in part will appear in the following description of the preferred embodiments and the claims, taken together with the drawings.

BRIEF DESCRIPTION OF DRAWINGS

The same reference numerals refer to the same elements throughout the various figures.

DETAILED DESCRIPTION OF PREFERRED EMBODIMENTS

Figure 1:
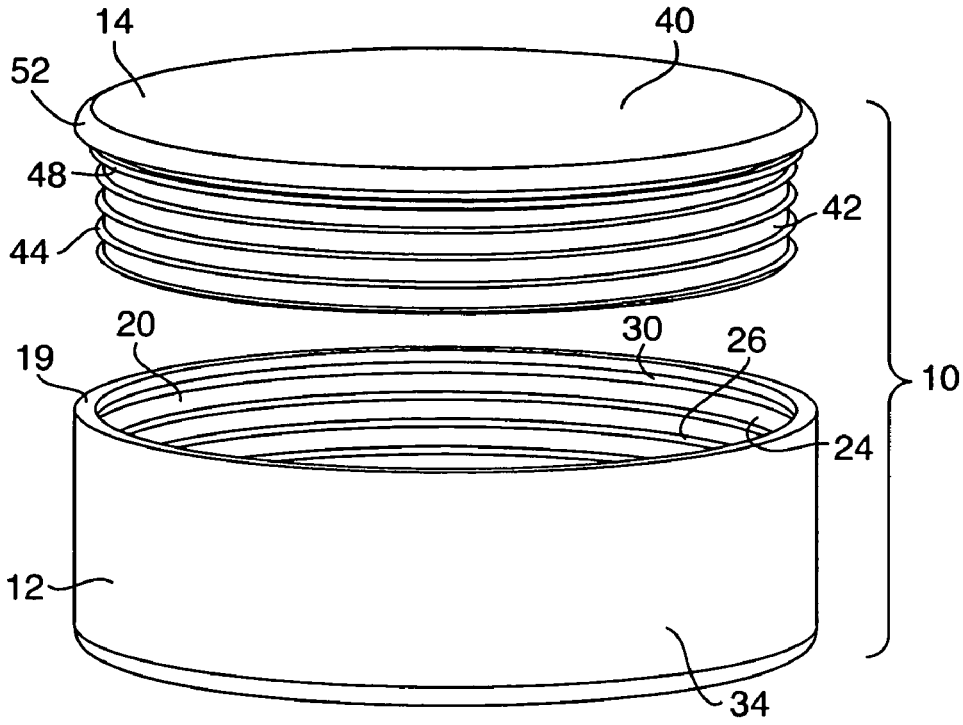
FIG. 1 is a perspective view of a storage container according to the invention herein, having the shape of a hockey puck and shown with its lid removed from its receptacle.
Figure 2:
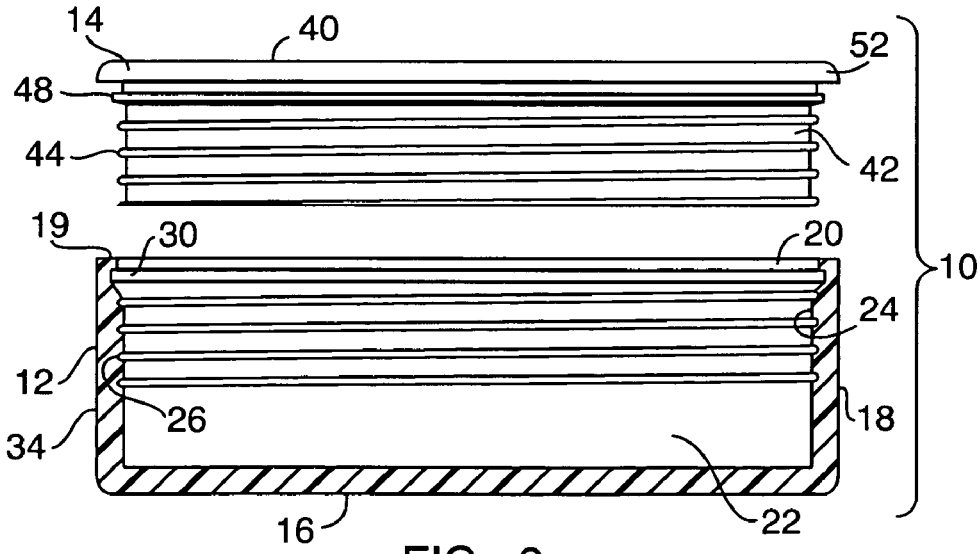
FIG. 2 is a side elevation view of the hockey puck storage container of FIG. 1, with its lid removed and the receptacle thereof shown in section.
Figure 3:
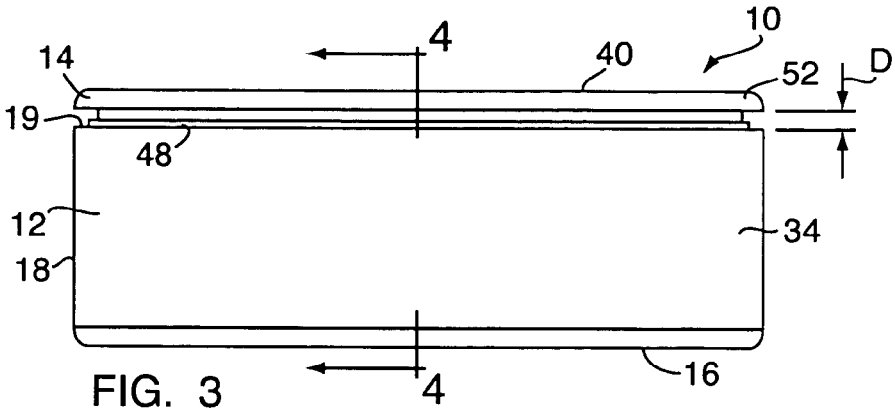
FIG. 3 is a side elevation view of the hockey puck storage container of FIG. 1, with the lid removably secured on the receptacle thereof.
Figure 4:
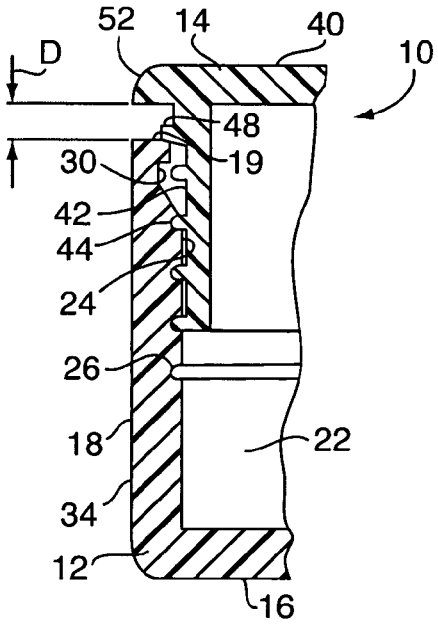
FIG. 4 is an enlarged fragmentary sectional view of the hockey puck storage container of FIG. 1, taken along the lines 4—4 of FIG. 3.
Figure 6:
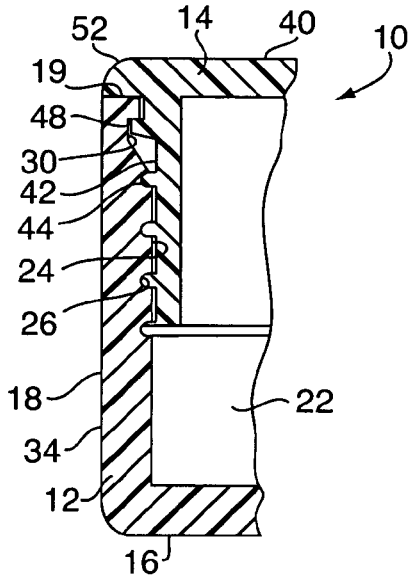
FIG. 6 is an enlarged fragmentary sectional view of the storage container of FIG. 1, taken along the lines 6—6 of FIG. 5.
Figure 5:
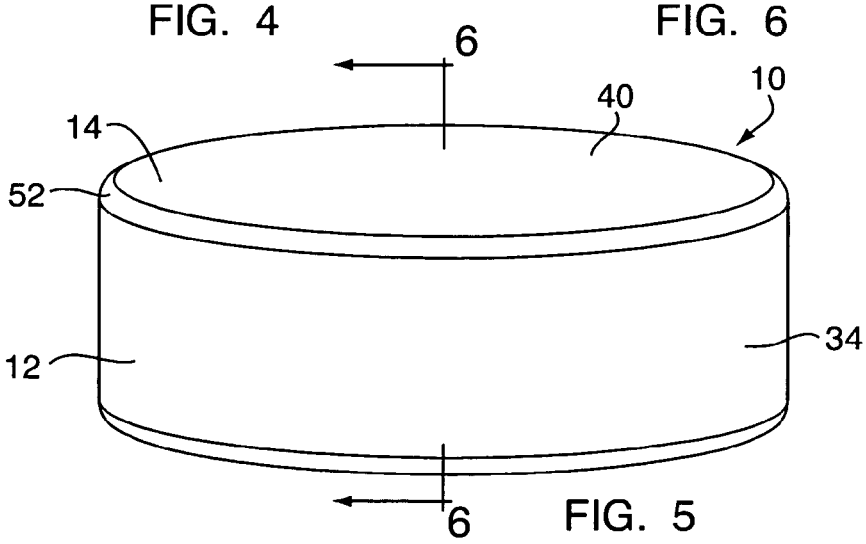
FIG. 5 is a side elevation view of the storage container of FIG. 1, shown with the lid permanently secured to the receptacle.
Figure 7:
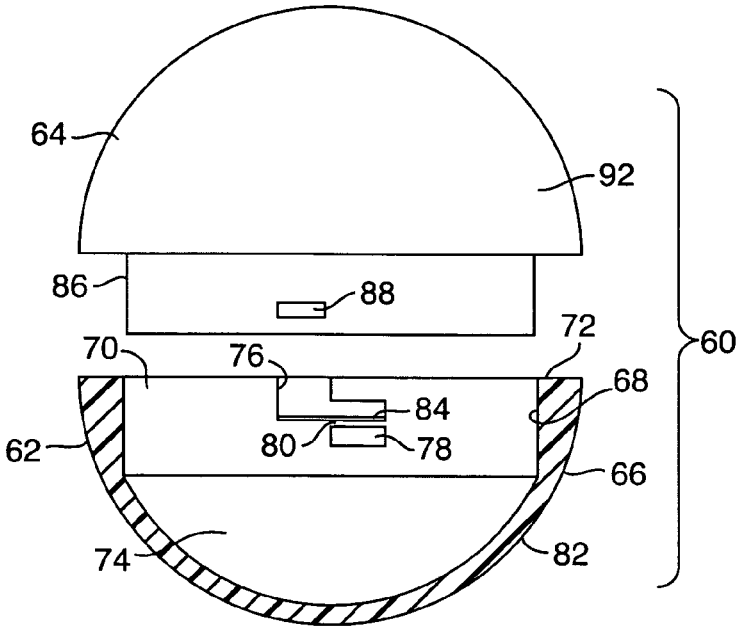
FIG. 7 is a side elevation view of another storage container according to the invention herein having the shape of a ball, and shown with the lid thereof removed from the receptacle thereof and the receptacle in section.

A first storage container 10 is illustrated in FIGS. 1–6, and generally comprises a receptacle 12 and a lid 14. When the lid 14 is removably secured on the receptacle 12, as shown in FIGS. 3 and 4, the storage container 10 may be used in connection with the sale and consumption of small items, and particularly edibly consumable items such as gum or candy. When the lid 14 is permanently secured on the receptacle 12, as shown in FIGS. 5 and 6, the storage container 10 has the shape of a hockey puck and may be used in playing street hockey or the like.

The receptacle 12 of the storage container 10 has a bottom 16 and a peripheral side wall 18 upstanding therefrom. The peripheral side wall 18 has an top rim 19 forming an entry opening 20 to the receptacle 12, and the bottom 16 and peripheral side wall 18 define a storage chamber within the receptacle 12.

The receptacle 12 also defines a bore 24 extending from the entry opening 20 into the storage chamber 22 of the receptacle 12. In the hockey puck configuration of the storage container 10, the bore 24 is formed on the interior surface of the peripheral side wall 18.

The bore 24 defines one part 26 of releasable engagement means for removably securing the lid 14 on the receptacle 12. In the storage container 10, the part 26 of the releasable engagement means is provided in the form of threads, also given reference numeral 26.

The bore 24 further defines a first part 30 of snap-fit securing means for permanently securing the lid 14 to the receptacle 12. In the storage container 10, the first part of the snap engagement means is provided in the form of a peripheral groove, also given reference number 30, positioned adjacent the entry opening 20 above the threads 26.

As noted above and shown in FIG. 6, when the receptacle 12 and the lid 14 are permanently secured together, the storage container 10 becomes a closed object with the shape of a hockey puck. The outer surface 34 of the receptacle 12 forms the partial exterior of the hockey puck.

The lid 14 of the storage container 10 has a top 40 and a depending cylindrical skirt 42. The cylindrical skirt 42 defines the second part 44 of releasable engagement means for removably securing the lid 14 to the receptacle 12, in the form of threads, also given reference number 44. The skirt also defines the second portion 48 of snap-fit securing means for permanently securing the lid 14 on the receptacle 12, in the form of a radially extending flange also given reference number 48. In the preferred embodiment shown, the peripheral groove 30 and the radially extending flange 48 are continuous about the periphery of bore 24 and the skirt 42, respectively, but it will be appreciated that the flange may be provided in arcuate sections and the peripheral groove 30 may be provided in corresponding alignable arcuate sections, if desired.

The bore 24 may be stepped or discontinuous, if desired, and the skirt may also be stepped. The terms "bore" and "skirt" as used herein are meant to provide nomenclature for the surfaces that define the releasable closure means and the snap-fit securement means, whether or not those surfaces and means are adjacent or spaced apart. The releasable engagement means and snap-fit securing means may be found at any suitable location or locations on the receptacle and lid, as desired.

The outer surface 52 of the lid 14 provides the remaining exterior of the hockey puck as a closed object.

With reference to FIGS. 1 and 2, when the lid 14 is removed from the receptacle, there is access to the storage chamber 22. Small items of virtually any type may be positioned within the storage chamber 22 for later retrieval. It is particularly anticipated that the small items may be gum or candy.

The skirt 42 of the lid 14 may be inserted through the entry opening 20 to engage the threads 44 of the skirt with the threads 26 of the bore 24 of the receptacle 12. The lid 14 may then be rotated to inter-engage the threads and thereby removably close the storage container 10, as shown in FIGS. 3 and 4. In the removably closed position, the flange 48 is engaged on the top rim 19, and the lid 14 including its outer surface 52 is spaced by an increment D above the receptacle 12 and its outer surface 34.

When the storage container 10 is sold with small items, such as gum or candy, therein, it will be appreciated that the container has the general appearance of a hockey puck with the exception of the gap increment D between the receptacle 12 and the lid 14. This shape is especially well adapted for marketing purposes, in that the outer surface 52 of the lid 14 is mostly a circular flat surface available to accept trademarks, logos, trade dress and product information. Additionally, the outer surface 34 of the receptacle 12 includes the outside of the peripheral wall 18 and the outside of bottom 16, which are also surfaces well-adapted to the display of trademarks, logos, trade dress and product information.

When it is no longer desired to use the storage container 10 as a receptacle 12 with a removable lid 14, the lid 14 may be permanently captured on the receptacle 12, thereby eliminating the increment D and achieving the co-joined exterior of a closed object, which in this embodiment is an object of sports play; namely a hockey puck. The storage container 10 configured as a closed object is shown in FIG. 6. This is achieved by applying axial compressive force to the receptacle 12 and lid 14 when they are in the removably secured position shown in FIGS. 3 and 4. The compressive force causes the flange 48 to snap-fit into the peripheral groove 30, as shown in FIGS. 5 and 6. It will be appreciated that the engaged threads 26 and 44 also experience an incremental indexing to accommodate the full insertion of the skirt 42 into the bore 24.

The receptacle 12 and lid 14 are thermoplastic or thermoplastic resin which is sufficiently flexible to achieve the snap engagement described above, and is sufficiently rigid to maintain the receptacle 12 and lid 14 as a permanently closed object, even when used as a hockey puck in street hockey games. A suitable resin for this purpose is polypropylene.

With reference to FIGS. 7–11, another storage container 60 according to the invention herein is illustrated. The storage container 60 has a receptacle 62 and a lid 64. The receptacle 62 has a generally concave outer wall 66, the inside surface of which has a bore 68 extending from an entry opening 70 at top rim 72. A storage chamber 74 is defined within the receptacle 62.

The bore 68 defines the first part 76 of releasable engagement means for removably securing the lid 64 on the receptacle 62, in the form of an L-shaped bayonet slot also given reference number 76. It will be appreciated that in FIG. 7 the receptacle 62 is shown in section so that bayonet slot 76 is visible, and that there is an additional bayonet slot formed in the bore 68 diametrically opposite the bayonet slot 76. If desired, three or more bayonet slots may be deployed about the bore 68.

Figure 9:
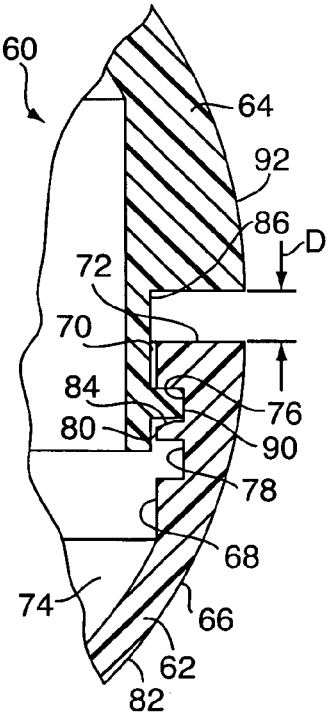
FIG. 9 is a sectional view of the ball storage container of FIG. 7 taken along the lines 9—9 of FIG. 8.
Figure 10:
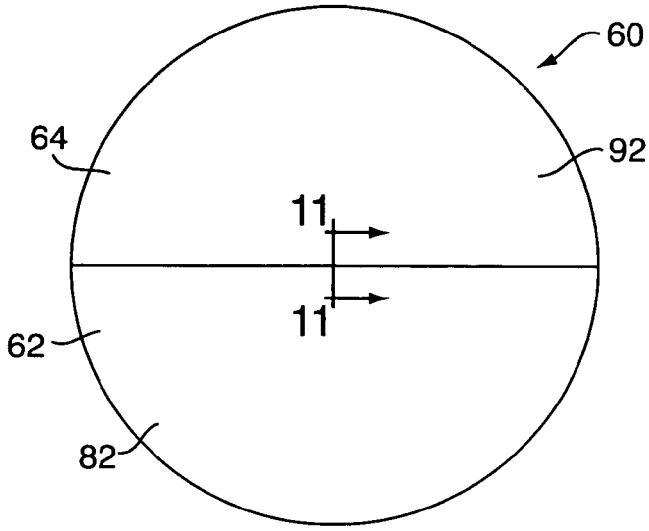
FIG. 10 is a side elevation view, partially schematic, of the storage container of FIG. 7 shown with the lid permanently secured on the receptacle thereof.
Figure 11:
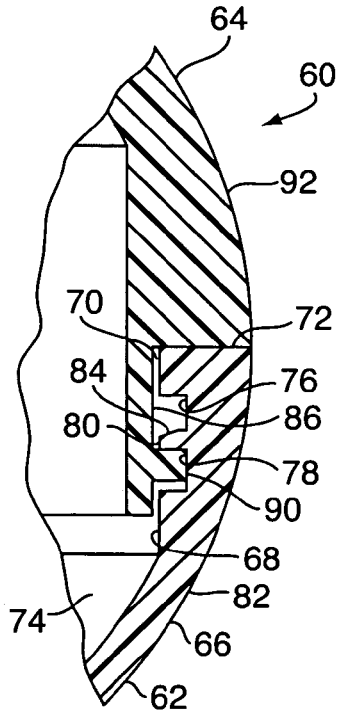
FIG. 11 is a sectional view of the ball storage container of FIG. 7, taken along the lines 11—11 of FIG. 10.

The bore 68 also defines the first part 78 of snap-fit securing means for permanently securing the lid 64 on receptacle 16. The first part of the snap-fit securing means is in the form of a groove or indentation, also designated at 78, formed below the L-shaped bayonet slot 76. With reference to FIGS. 9 and 10, the groove 78 is separated from the bayonet slot 76 by portion 80 of the bore 68. A diametrically opposed groove is similarly provided below the diametrically opposed second bayonet slot.

The outer surface 82 of the receptacle 12 is hemispherical, and therefore forms a portion of the exterior of a closed object in the form of a ball.

The lid 64 of the storage container 60 has a depending skirt 86, which fits into the bore 68. The skirt has a flange 88 extending radially outwardly therefrom. The skirt 86 is not shown in section in FIG. 7, and there is a second flange 90 diametrically opposed to flange 88, so that flange 90 cooperates with the bayonet slot 76 and the groove 78 disposed below it, as discussed below. The outer surface 92 of the lid 64 is also hemispherical, and defines the remainder of the exterior of a closed object in the shape of a ball.

Figure 8:
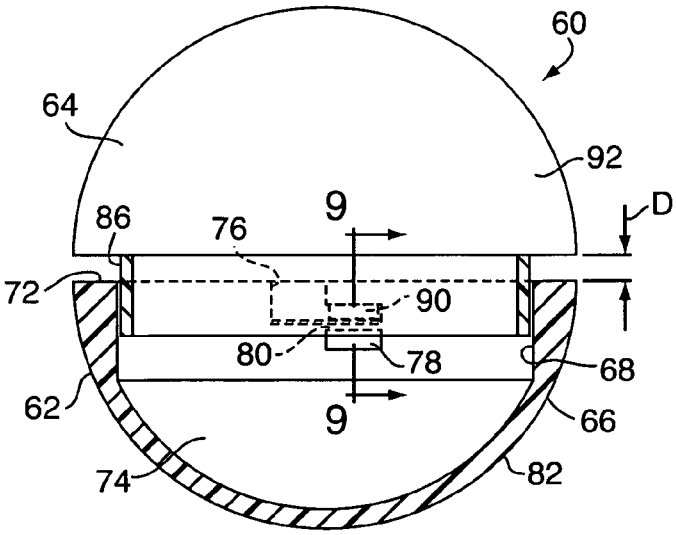
FIG. 8 is a side elevation view partially in section and partially dotted, of the ball storage container of FIG. 1, showing the lid removably received on the receptacle thereof.

With reference to FIGS. 8 and 9, the lid 64 may be releasably secured on the receptacle 62 by inserting the skirt in bore 68, including inserting the flanges 88 and 90 into the bayonet slot 76 and its diametrically opposed counterpart. The lid 64 is then rotated to place the flanges 88, 90 in the lower legs of the L-shaped bayonet slots 76, etc., and a frictional or detente engagement may be provided to releasably retain the flanges in the bayonet slots. When the lid 64 is removably secured on the receptacle 12, the outer surface 82 of the receptacle is incrementally spaced by distance D from the outer surface 92 of the lid 64. The lid 64 may be removed by counter-rotation and axial retraction of the flanges from the bayonet slots.

It will, of course, be understood that the flanges of a bayonet-type releasable engagement means may extend from the bore 68 and the bayonet slots may be formed on the skirt 86, to provide for removably securing the lid 64 on the receptacle 62.

The storage container 60 may be used to package a variety of types of items in the storage chamber 66 and it will be further appreciated that the concave interior of lid 64 provides additional volume to the storage chamber 66 for containing items. The outer surfaces 82, 92 of the receptacle and lid are available for trademarks, logos, trade dress and product information, which may be applied as desired.

With reference to FIG. 10, the lid 64 may be permanently secured on the receptacle 62 by snap-fit engagement of the flange 88 in the groove 78 located below the bayonet slot 76 and snap-fit engagement of flange 90 into the diametrically opposed counterpart of groove 78. Axial compressive force causes the flange 88 to snap over the portion 80 of the bore 68, which may be provided with a ramped surface 84 to facilitate the process of the snap-fit engagement. Once the lid is permanently secured on the receptacle 62, the outer surfaces 82 and 92 of the receptacle 62 and lid 64, respectively, are co-joined to form the exterior of a closed object; namely, a ball.

It will be appreciated that lids and receptacles having outer surfaces forming the exterior of various kinds and shapes of closed objects may be substituted for the hockey puck and ball described herein. The other shapes may be ovoid, such as a football, or may even be polygonal, particularly when a bayonet-type releasable inter-engagement means is utilized for removably securing the lid and cover. Various forms of releasable engagement means and snap-fit securing means may also be employed.

Therefore, storage containers that are convertible to closed objects have been described which admirably fulfill the objects of the invention herein. It will be appreciated that the embodiments described are illustrative only and that those skilled in the art may make various changes and modifications in accordance with the principles of the invention, which is limited only by the scope of the following claims.

I claim:

1. A storage container convertible to a permanently closed object, the container comprising:

A) a receptacle having an outside surface corresponding to the partial exterior of a closed object; and having an interior surface defining a storage chamber with an entry opening thereto;

B) a lid for covering the entry opening and thereby closing the storage chamber, the lid having an outside surface corresponding to the remaining exterior of the closed object;

C) the receptacle and lid together defining:

1) releasable engagement means for removably securing the lid on the receptacle, wherein the lid may be removed to place and remove items from the storage chamber, the releasable engagement means inter-engaging as the lid is placed on the receptacle; and 2) snap-fit securing means incrementally spacing the outside surfaces corresponding to the partial and remaining exterior of the closed object when the lid is removably secured on the receptacle and permanently securing the lid on the receptacle with the outside surfaces corresponding to the partial and remaining exteriors of the closed object co-joined when the lid is displaced toward the receptacle to place the snap fit securing means in snap fit engagement.

2. A storage container convertible to a permanently closed object as defined in claim 1 wherein the co-joined exteriors of the lid and receptacle form an object of sports play.

3. A storage container convertible to a permanently closed object as defined in claim 2 wherein the object of sports play is a hockey puck.

4. A storage container convertible to a permanently closed object as defined in claim 2 wherein the object of sports play is a ball.

5. A storage container convertible to a permanently closed object as defined in claim 1 wherein the interior surface of the receptacle defines a bore extending from the entry opening and the lid has a skirt receivable in the bore, the bore and the skirt together defining the releasable engagement means and the snap-fit securing means.

6. A storage container convertible to a permanently closed object as defined in claim 5 wherein the releasable engagement means are inter-engaging threads respectively defined on the bore and the skirt.

7. A storage container convertible to a permanently closed object as defined in claim 6 wherein the snap-fit securing means comprise a flange radially extending from the skirt and a groove defined in the bore.

8. A storage container convertible to a permanently closed object as defined in claim 7 wherein the groove is continuous about the periphery of the bore adjacent the entry opening.

9. A storage container convertible to a permanently closed object as defined in claim 8 wherein the flange is continuous about the periphery of the skirt.

10. A storage container convertible to a permanently closed object as defined in claim 1 wherein the releasable engagement means is an L-shaped bayonet slot formed in one of the bore and the skirt and a cooperating flange formed on the other of the bore and the skirt.

11. A storage container convertible to a permanently closed object as defined in claim 10 wherein the L-shaped bayonet slot is formed in the bore.

12. A storage container convertible to a permanently closed object as defined in claim 10 wherein two diametrically opposed bayonet slots are formed in the bore and two diametrically opposed cooperating flanges are formed on the skirt.

13. A storage container convertible to a permanently closed object as defined in claim 12 wherein the snap-fit securing means are two grooves defined in the skirt below the L-shaped bayonet slot for receiving the two flanges in snap fit securement.

14. A storage container convertible to a permanently closed object as defined in claim 10 wherein the snap-fit securing means comprises a groove formed in one of the bore and skirt below the L-shaped bayonet slot formed therein.

15. A container convertible to a permanently closed object, comprising:

A) a receptacle having an outside surface corresponding to the partial exterior of the closed object and having an inside surface defining a storage chamber;

B) the inside surface including a bore extending from an entry opening, the bore defining a first portion of releasable engagement means, the bore further defining a groove;

C) a lid for covering the entry opening and thereby closing the storage chamber, the lid having an outside surface corresponding to the remaining exterior of the closed object;

D) the lid including a skirt receivable in the bore of the receptacle, the skirt defining a second portion of the releasably engaging means for cooperating with the first portion thereof to removably secure the lid on the receptacle with the partial and remaining exteriors of the closed object incrementally spaced apart, the releasable engagement means configured to inter-engage as the skirt is inserted into the bore, the skirt further defining a flange abutting the receptacle adjacent the entry opening to hold the partial and remaining exteriors incrementally spaced apart and which is non-releasably receivable in the groove defined in the bore of receptacle when the partial and remaining exteriors of the closed object are co-joined.

16. A storage container convertible to a permanently closed object as defined in claim 15 wherein the co-joined exteriors of the lid and receptacle form an object of sports play.

17. A storage container convertible to a permanently closed object as defined in claim 16 wherein the object of sports play is a hockey puck.

18. A storage container convertible to a permanently closed object as defined in claim 15 wherein the releasable engagement means are inter-engaging threads respectively defined on the bore and the skirt.

19. A storage container convertible to a permanently closed object as defined in claim 15 wherein the groove is continuous about the periphery of the bore.

20. A storage container convertible to a permanently closed object as defined in claim 19 wherein the flange is continuous about the periphery of the skirt.

* * * * *